US009200875B1

(12) United States Patent
Saucedo et al.

(10) Patent No.: US 9,200,875 B1
(45) Date of Patent: Dec. 1, 2015

(54) CONVERTIBLE BALLISTIC SHIELD

(71) Applicant: ARMORWORKS ENTERPRISES, LLC, Chandler, AZ (US)

(72) Inventors: Kent D. Saucedo, Mesa, AZ (US); Brent D. Grove, Phoenix, AZ (US)

(73) Assignee: ARMORWORKS Enterprises, LLC, Chandler, AZ (US)

( * ) Notice: Subject to any disclaimer, the term of this patent is extended or adjusted under 35 U.S.C. 154(b) by 0 days.

(21) Appl. No.: 13/863,620

(22) Filed: Apr. 16, 2013

Related U.S. Application Data

(63) Continuation of application No. 12/799,199, filed on Apr. 20, 2010, now Pat. No. 8,418,595.

(60) Provisional application No. 61/214,137, filed on Apr. 20, 2009.

(51) Int. Cl.
*F41H 7/00* (2006.01)
*F41H 5/08* (2006.01)
*F41H 5/26* (2006.01)

(52) U.S. Cl.
CPC ... *F41H 5/08* (2013.01); *F41H 5/26* (2013.01)

(58) Field of Classification Search
USPC ..... 89/36.07, 36.05, 36.01, 36.02
See application file for complete search history.

(56) References Cited

U.S. PATENT DOCUMENTS

| | | | | |
|---|---|---|---|---|
| 7,302,880 | B1 * | 12/2007 | Elasic | 89/36.07 |
| 8,015,910 | B1 * | 9/2011 | Fuqua et al. | 89/36.09 |
| 2008/0121100 | A1 * | 5/2008 | Pastrnak et al. | 89/36.09 |
| 2013/0205983 | A1 * | 8/2013 | Martin | 89/36.07 |
| 2014/0208932 | A1 * | 7/2014 | Lee | 89/36.09 |
| 2014/0238225 | A1 * | 8/2014 | Mickiewicz | 89/36.07 |

* cited by examiner

*Primary Examiner* — J. Woodrow Eldred
(74) *Attorney, Agent, or Firm* — Schwartz Law Firm, P.C.

(57) ABSTRACT

A convertible ballistic shield includes a plurality of cooperating ballistic panels. Each ballistic panel has a threat-side surface and a protected-side surface, and opposing end edges. A first elongated panel strap is attached to the threat-side surface of one of the ballistic panels between its opposing end edges. A second elongated panel strap is attached to the protected-side surface of an adjacent one of the ballistic panels between its opposing end edges. A ring connector is slidably linked to both of the first and second panel straps. The ring connector is adapted for slidably interconnecting the adjacent panels together wherein the threat-side surface of one panel is adapted to overlie the protected-side surface of the adjacent panel, and the adjacent panels are slidably movable relative to one another such that an overall length of the ballistic shield is selectively adjustable between a fully retracted condition and a fully extended condition.

12 Claims, 9 Drawing Sheets

CONVERTIBLE BALLISTIC SHIELD

TECHNICAL FIELD AND BACKGROUND

The present disclosure relates broadly and generally to the ballistics industry, and more particularly to a convertible portable (e.g., hand-held) ballistic shield applicable for military and law enforcement usage.

SUMMARY OF EXEMPLARY EMBODIMENTS

Various exemplary embodiments of the present invention are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

It is also noted that terms like "preferably", "commonly", and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

According to one exemplary embodiment, the present disclosure comprises a convertible ballistic shield comprising a plurality of cooperating ballistic panels. Each ballistic panel has a threat-side surface and a protected-side surface, and opposing end edges. Means are provided for slidably interconnecting adjacent ones of the ballistic panels, wherein the protected-side surface of one panel is adapted to overlie the threat-side surface of the adjacent panel, and at least one of the adjacent panels is slidably movable relative to the other such that an overall length of the ballistic shield is selectively adjustable between a fully retracted (or "closed" or "stowed") condition and a fully extended (or "deployed") condition.

The "means" for slidably interconnecting the adjacent panels may comprise any suitable structure or structural elements sufficient to enable sliding linear adjustment of one panel relative to the other. Examples of such structure or structural elements include cooperating tracks or guides, cooperating straps and rings, a telescoping panel assembly, pivot attachments, and the like. These examples are provided by way of illustration and only, and are not intended as a complete and comprehensive listing of all structurally equivalent alternatives to the present disclosure.

According to another exemplary embodiment, in the fully retracted condition of the ballistic shield, the adjacent panels are substantially entirely superimposed such that their respective opposing end edges reside in substantial alignment.

According to another exemplary embodiment, in the fully extended condition of the ballistic shield, the adjacent panels are separated (e.g., moved apart or extended) such that the opposing end edges of one panel are substantially linearly displaced from corresponding opposing end edges of the other panel.

According to another exemplary embodiment, in the fully extended condition of the ballistic shield, the adjacent panels substantially overlap at respective proximal (or adjacent) end edges of the panels.

According to another exemplary embodiment, at least one of the ballistic panels has a pocket.

According to another exemplary embodiment, a rigid impact plate is received within the pocket of the ballistic panel.

According to another exemplary embodiment, a flashlight is removably carried by one of the ballistic panels.

According to another exemplary embodiment, an adjustable arm strap and hand grip are located on the protected-side surface of one of the ballistic panels.

According to another exemplary embodiment, at least one of said ballistic panels incorporates a flexible ballistic laminate structure comprising bundled high performance continuous fibers.

According to another exemplary embodiment, the high performance continuous fibers are selected from a group consisting of S-glass, aramid, high molecular weight polyethylene (HMWPE), polybenzobisoxazole (PBO), and polypyridobisimidazole (PIPD).

According to another exemplary embodiment, in the fully retracted condition of the ballistic shield, the overlying ballistic panels have a combined thickness of less than 6 inches.

According to another exemplary embodiment, at least one of the ballistic panels includes a substantially transparent sight window.

According to another exemplary embodiment, the overall length of the ballistic shield in the fully extended condition is greater than 3 times the overall length of the ballistic shield in the fully retracted condition.

In another exemplary embodiment, the disclosure comprises a convertible ballistic shield including a plurality of cooperating ballistic panels. Each ballistic panel has a threat-side surface and a protected-side surface, and opposing end edges. A first elongated panel strap is attached to the threat-side surface of one of the ballistic panels between its opposing end edges. A second elongated panel strap is attached to the protected-side surface of an adjacent one of the ballistic panels between its opposing end edges. A ring connector is slidably linked to both of the first and second panel straps. The ring connector is adapted for slidably interconnecting the adjacent panels together wherein the threat-side surface of one panel is adapted to overlie the protected-side surface of the adjacent panel. The adjacent panels are slidably movable relative to one another such that an overall length of the ballistic shield is selectively adjustable between a fully retracted condition and a fully extended condition.

BRIEF DESCRIPTION OF THE DRAWINGS

The description of exemplary embodiments proceeds in conjunction with the following drawings, in which.

DESCRIPTION OF EXEMPLARY EMBODIMENTS AND BEST MODE

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 1:
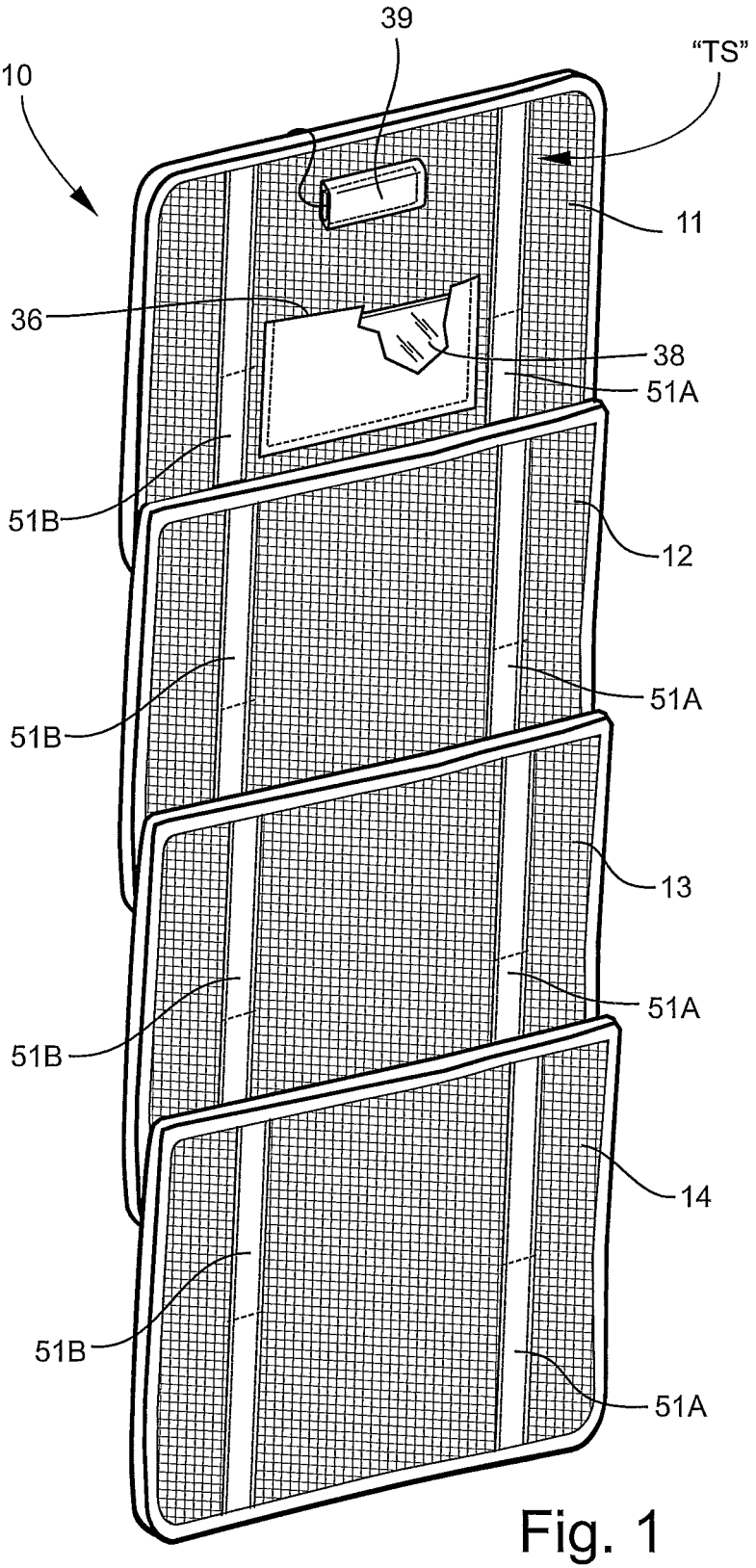
FIG. 1 is a perspective view showing the threat-side surface of an exemplary convertible ballistic shield in the fully extended or deployed condition.
Figure 3:
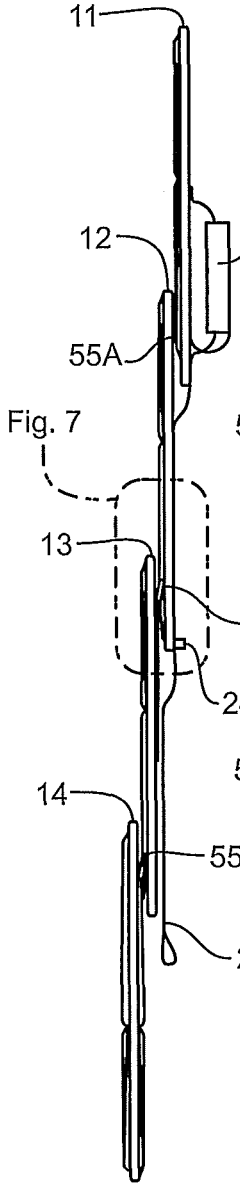
FIG. 3 is a side elevation of the exemplary shield in the deployed condition.

Referring now specifically to the drawings, a convertible portable ballistic shield according to one exemplary embodiment of the present invention is illustrated in FIG. 1, and shown generally at reference numeral 10. The exemplary ballistic shield 10 comprises multiple cooperating ballistic panels 11, 12, 13, and 14, each panel having a threat-side surface "TS" and protected-side surface "PS" (See FIG. 2), and opposing end edges and opposing side edges. The ballistic panels 11-14 are slidably interconnected, as described below, such that the threat-side surface "TS" of one panel is designed to selectively overlie the protected-side surface "PS" of the adjacent panel; or in the case of the bottom panel 14, the protected-side surface "PS" selectively overlies the threat-side surface "TS" of the adjacent panel 13. Sliding displacement of adjacent panels 11-14 selectively adjusts the overall length of the ballistic shield 10, and enables conversion of the shield 10 between a fully extended (or "deployed") condition, shown in FIGS. 1, 2, and 3, and a fully retracted (or "closed") condition shown in FIGS. 4, 5, and 6.

Figure 2:
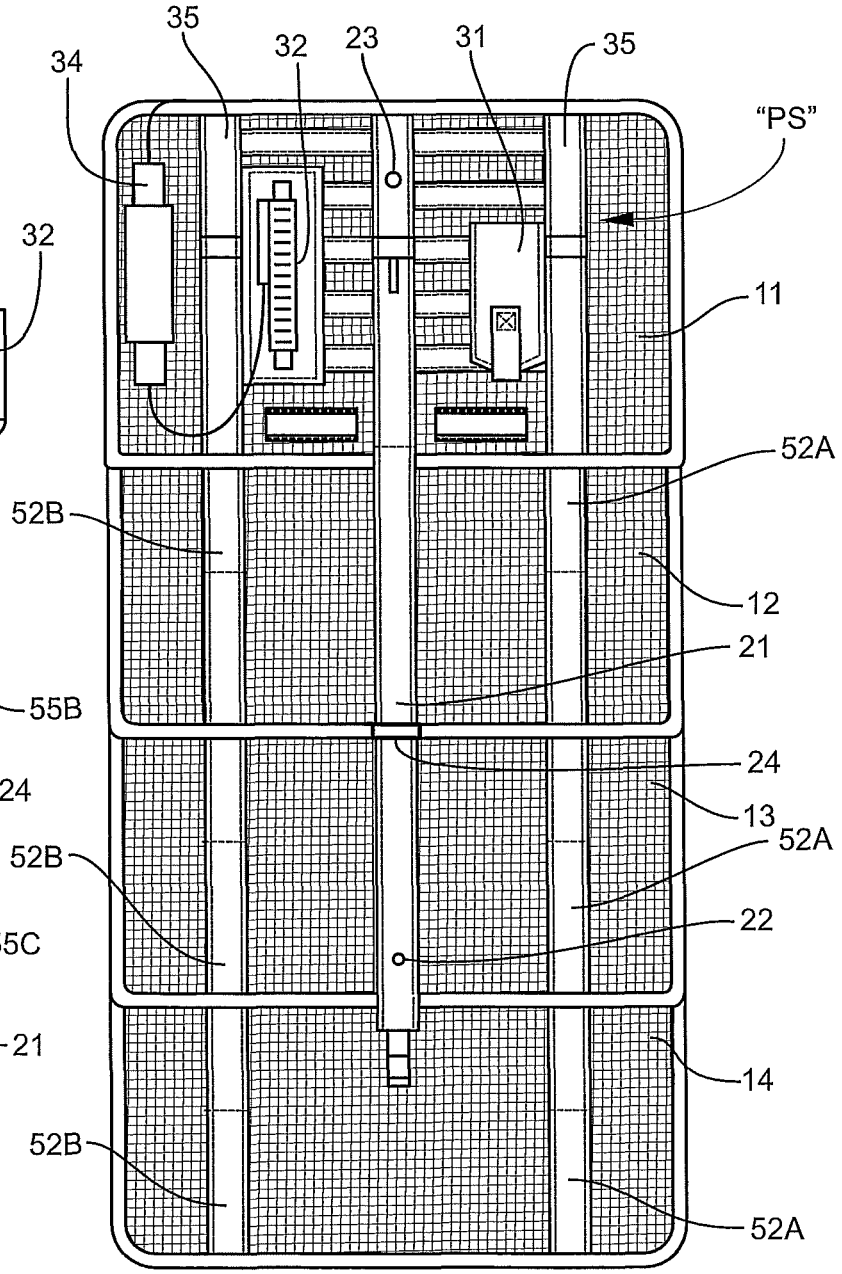
FIG. 2 is a view showing the protected-side surface of the exemplary shield in the deployed condition.
Figure 4:
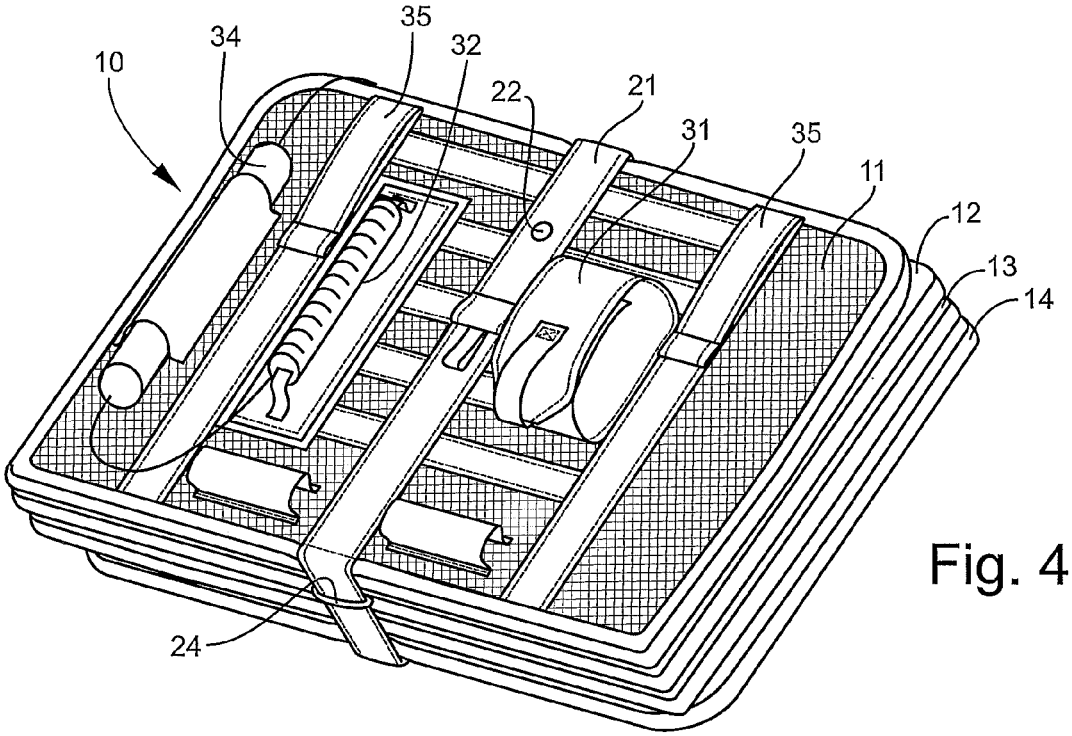
FIG. 4 is a perspective view of the exemplary shield in the fully retracted or stowed condition.
Figure 5:
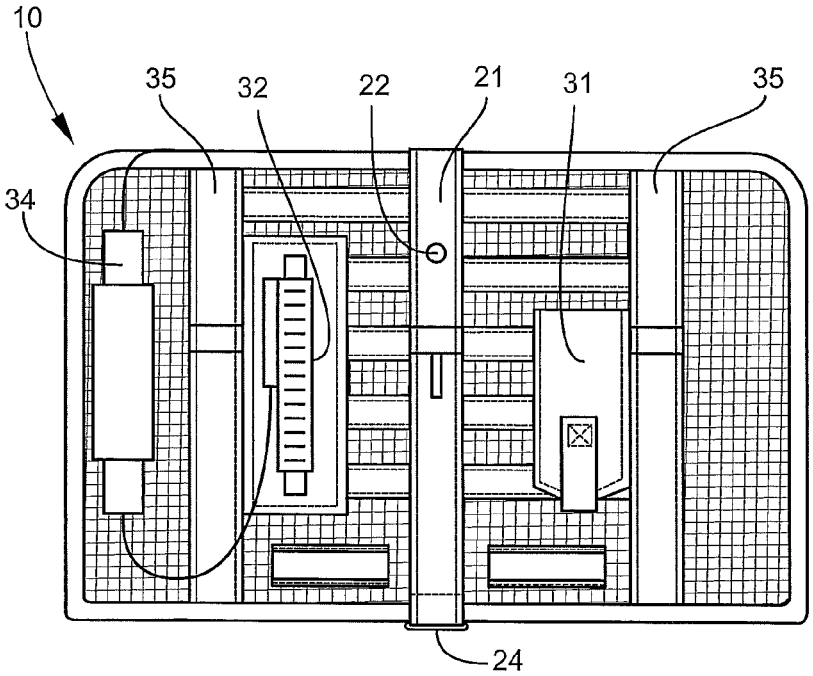
FIG. 5 is a top view of the exemplary shield in the retracted condition and illustrating the substantial overlying alignment of the multiple ballistic panels.
Figure 6:
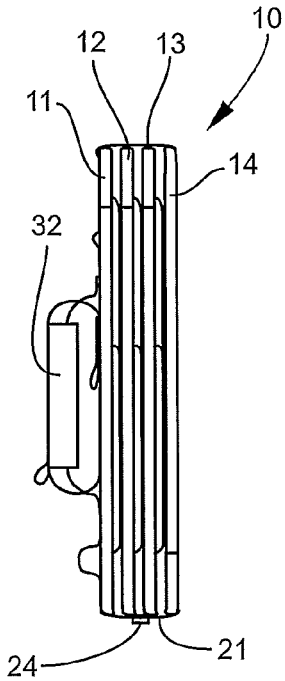
FIG. 6 is side elevation of the exemplary shield in the retracted condition and further illustrating the substantial overlying panel alignment.

When the ballistic shield 10 is fully retracted, the ballistic panels 11-14 are superimposed such that their respective end and side edges reside in substantial overlying alignment. An elongated flexible retention strap 21, best shown in FIGS. 2, 4, and 5, functions to releasably hold the ballistic shield 10 in the closed condition. The retention strap 21 is connected to a bottom end edge of the top ballistic panel 11, as shown in FIG. 2, and has a male snap fastener 22 at its free end designed to mate with a complementary female snap fastener 23 on the protected-side surface "PS" of the top panel 11. The retention strap 21 passes through a guide loop 24 at the bottom end edge of the adjacent panel 12, and wraps around an outside of the overlying panels 11-14 to releasably close the ballistic shield 10 as shown in FIGS. 4 and 5. When partially or fully extended, the exemplary ballistic shield 10 is flexible at respective joints between adjacent ballistic panels 11-14. In this condition, the adjacent panels 11-14 overlap at the joints (respective proximal end edges) to form a solid continuous and seamless ballistic barrier. The ballistic panels 11-14 themselves may also be slightly to moderately flexible or bendable; or alternatively, the panels 11-14 may be semi-rigid to entirely rigid.

Referring to FIGS. 2, 3, 4, 5, and 6, the top ballistic panel 11 may comprise an adjustable arm strap 31 and hand grip 32 located on its protected-side surface "PS", and user accessories including a small flashlight 34 and various article-holding straps 35. A pocket 36 (FIG. 1) may be located on the opposite threat-side surface "TS" of the top panel 11 for carrying an impact plate 38 or other insert. The impact plate 38 may be formed of a rigid PVC or other hard composite suitable for protecting the arm of the user against injury resulting from blunt object blows (as with a baseball bat, crowbar, or the like). Additionally, a light assembly housing 39 and other accessories and article-holding straps (not shown) may be located adjacent the pocket 36 on the threat-side surface "TS" of the top panel 11.

Figure 7:
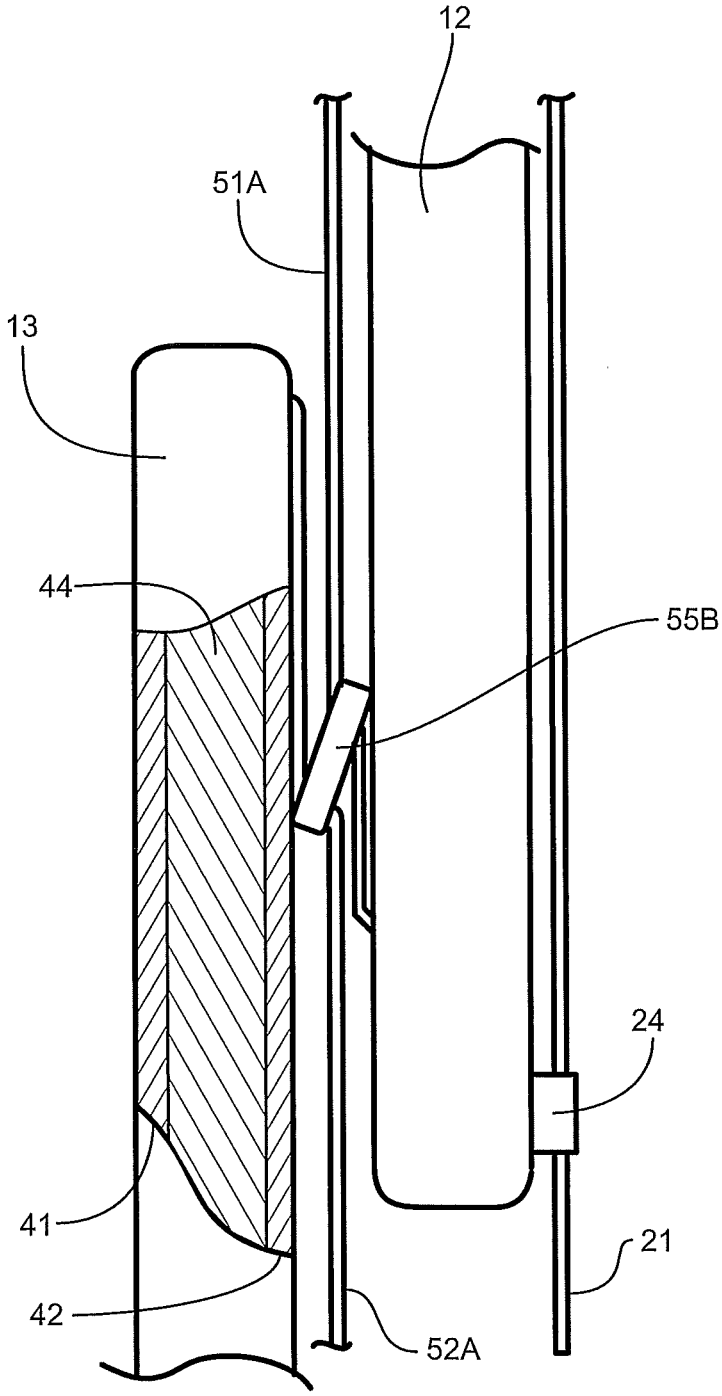
FIG. 7 is an enlarged fragmentary view in partial cross-section of the shield area designated in FIG. 3.

In the exemplary embodiment, each ballistic panel 11-14 measures approximately 24-inches wide and 15-inches tall. The present exemplary shield 10 comprises four (4) such ballistic panels 11-14. In other embodiments, the ballistic shield 10 may comprise any other desired number of panels of any desired shape and dimension. As shown in FIG. 7, the exemplary panels 11-14 are constructed of a ballistic composite comprising outside fabric layers 41, 42 and an intermediate multi-ply laminate structure 44 incorporating bundled high performance continuous fibers. Examples of high performance fibers include S-glass composed of silica ($SiO_2$), alumina ($Al_2O_3$), and magnesia (MgO); aramid fibers, such as commercially-known Twaron®, Technora®, and DuPont's Kevlar®29, Kevlar® 49, Kevlar® 129, and Kelvar® KM2; high molecular weight polyethylene (HM-WPE), such as commercially-known Spectra® and Dyneema®; polybenzobisoxazole (PBO) fibers, such as commercially-known Zylon®; and polypyridobisimidazole (PIPD), such as commercially-known M5®. These fibers have high tensile strength, elastic modulus, and strain to failure. For example, such fibers may have a tensile strength greater than about 2000 MPa and an elastic modulus greater than about 60 GPa. Fibers structures in the exemplary application may be unidirectional, plain, or basket weave configurations. The unidirectional fiber layers may be rotated 90° (or other angle) with respect to adjacent layers to create a cross-ply fabric. The exemplary laminate structure 44 comprises between 25-30 overlying plies intermediate the outside fabric layers 41, 42. The outside fabric layers 41, 42 may comprise aramid or other suitable shell fabrics.

Slidable interconnection of adjacent ballistic panels 11-14 is best illustrated in FIGS. 1, 2, 3, 7, and 8A-8C. Each ballistic panel 11-14 comprises an outside pair of laterally-spaced elongated panel straps 51A, 51B (FIG. 1) attached to its threat-side surface "TS" and an inside pair of laterally-spaced elongated panel straps 52A, 52B (FIG. 2) attached to its protected-side surface "PS". The panels straps 51A, 51B & 52A, 52B in each pair extend between opposing end edges of the ballistic panel 11-14, and are attached to the panel 11-14 (e.g., by sewing) at bottom, intermediate, and top points "A", "B", and "C", respectively, shown in FIG. 8A. The panel straps 51A, 51B & 52A, 52B are unattached to the ballistic panel 11-14 between the bottom and intermediate attachment points "A" and "B", and between the intermediate and top attachment points "B" and "C". Ring connectors 55A, 55B, and 55C (in a substantially flattened O-shape) are applied to respective panel straps 51A, 51B & 52A, 52B on the threat-side and protected-side surfaces of adjacent ballistic panels 11-14 to slidably join the panels 11-14 together and allow linear displacement of one panel relative to the other.

Figures 8A, 8B, 8C:
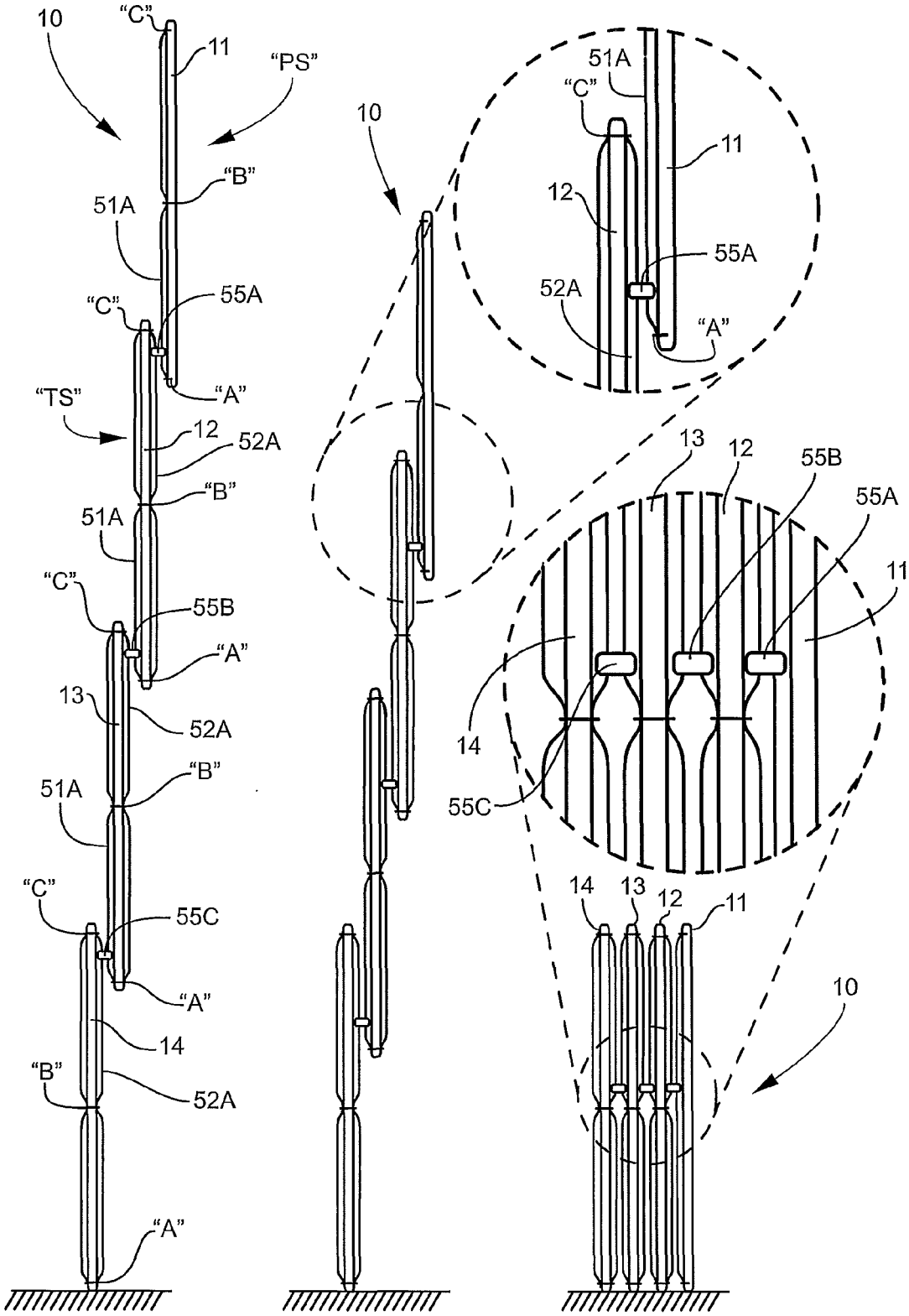
FIGS. 8A, 8B, and 8C are views demonstrating sequential collapsing of the ballistic shield from the fully extended condition to the fully retracted condition.

As best demonstrated in FIGS. 8A-8C, in the exemplary embodiment the first pair of ring connectors 55A (only one shown) encircle the panel straps 51A (51B not shown) on the threat-side surface "TS" of the top panel 11 and the panel straps 52A (52B not shown) on the protected-side surface "PS" of the adjacent second panel 12. The ring connectors 55A interconnect the adjacent panels 11, 12 together, and allow sliding vertical movement of the panels 11, 12 within a linear range defined by the bottom and intermediate attachment points "A" and "B" of the top panel 11, and the intermediate and top attachment points "B" and "C" of the second panel 12. The second pair of ring connectors 55B (only one shown) encircle the panel straps 51A (51B not shown) on the threat-side surface "TS" of the second panel 12 and the panel straps 52A (52B not shown) on the protected-side surface "PS" of the adjacent third panel 13. As previously described, the ring connectors 55B interconnect the adjacent panels 12, 13 together, and allow sliding vertical movement of the panels 12, 13 within a linear range defined by the bottom and intermediate attachment points "A" and "B" of the second panel 12, and the intermediate and top attachment points "B" and "C" of the third panel 13. The third pair of ring connectors 55C (only one shown) encircle the panel straps 51A (51B not shown) on the threat-side surface "TS" of the third panel 13 and the panel straps 52A (52B not shown) on the protected-side surface "PS" of the adjacent bottom panel 14. Again, the ring connectors 55C interconnect the adjacent panels 13, 14 together, and allow sliding vertical movement of the panels 13, 14 within a linear range defined by the bottom and intermediate attachment points "A" and "B" of the third panel 13, and the intermediate and top attachment points "B" and "C" of the bottom panel 14. For example, the ballistic shield 10 is shown in the fully extended condition in FIG. 8A, a partially retracted condition in FIG. 8B, and in the closed fully retracted condition in FIG. 8C.

Figure 9:
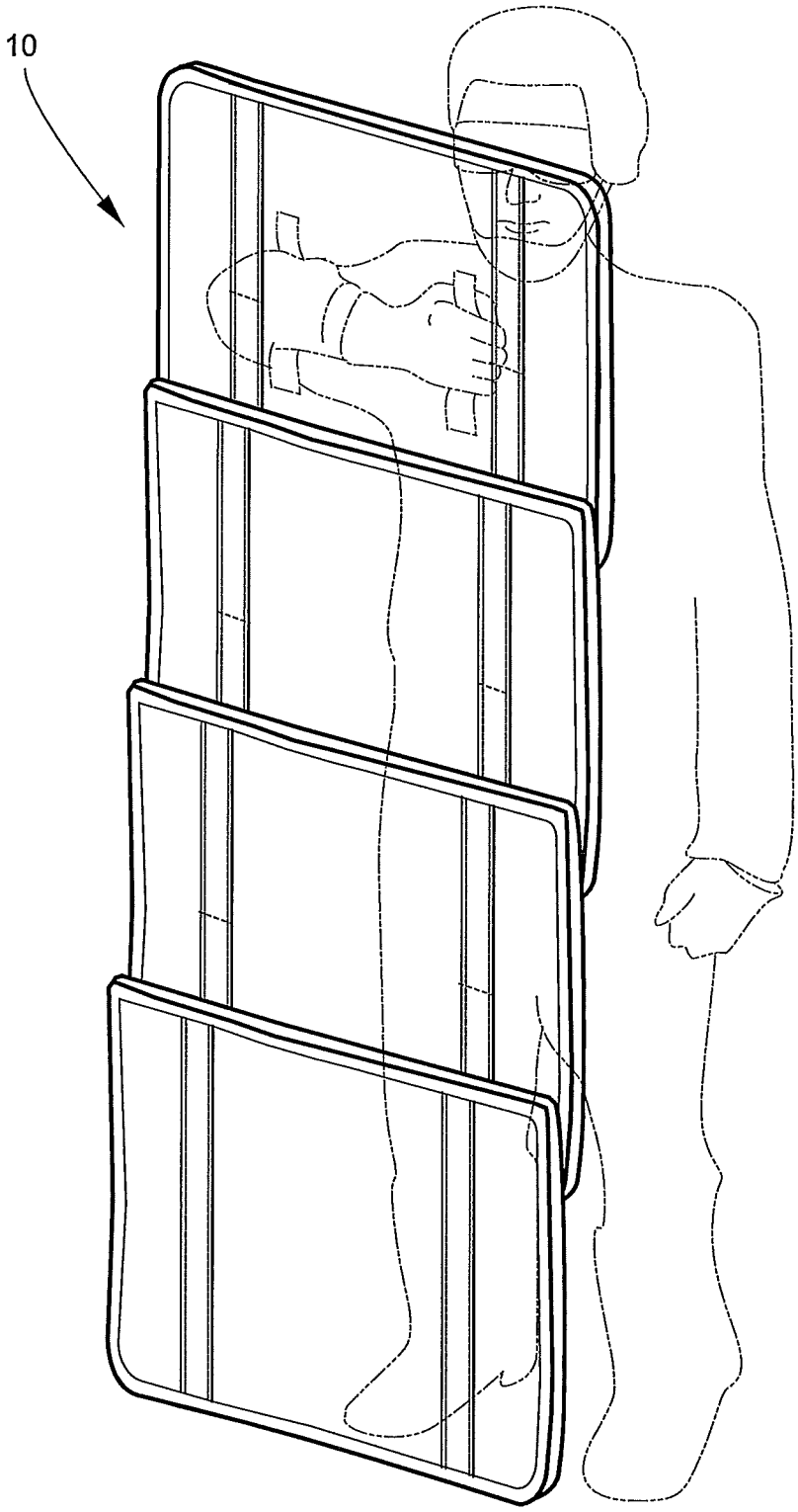
FIGS. 9, 10, and 11 are views demonstrating automatic conversion of the ballistic shield to provide continuous maximum protection for the user under different exemplary use scenarios.
Figure 10:
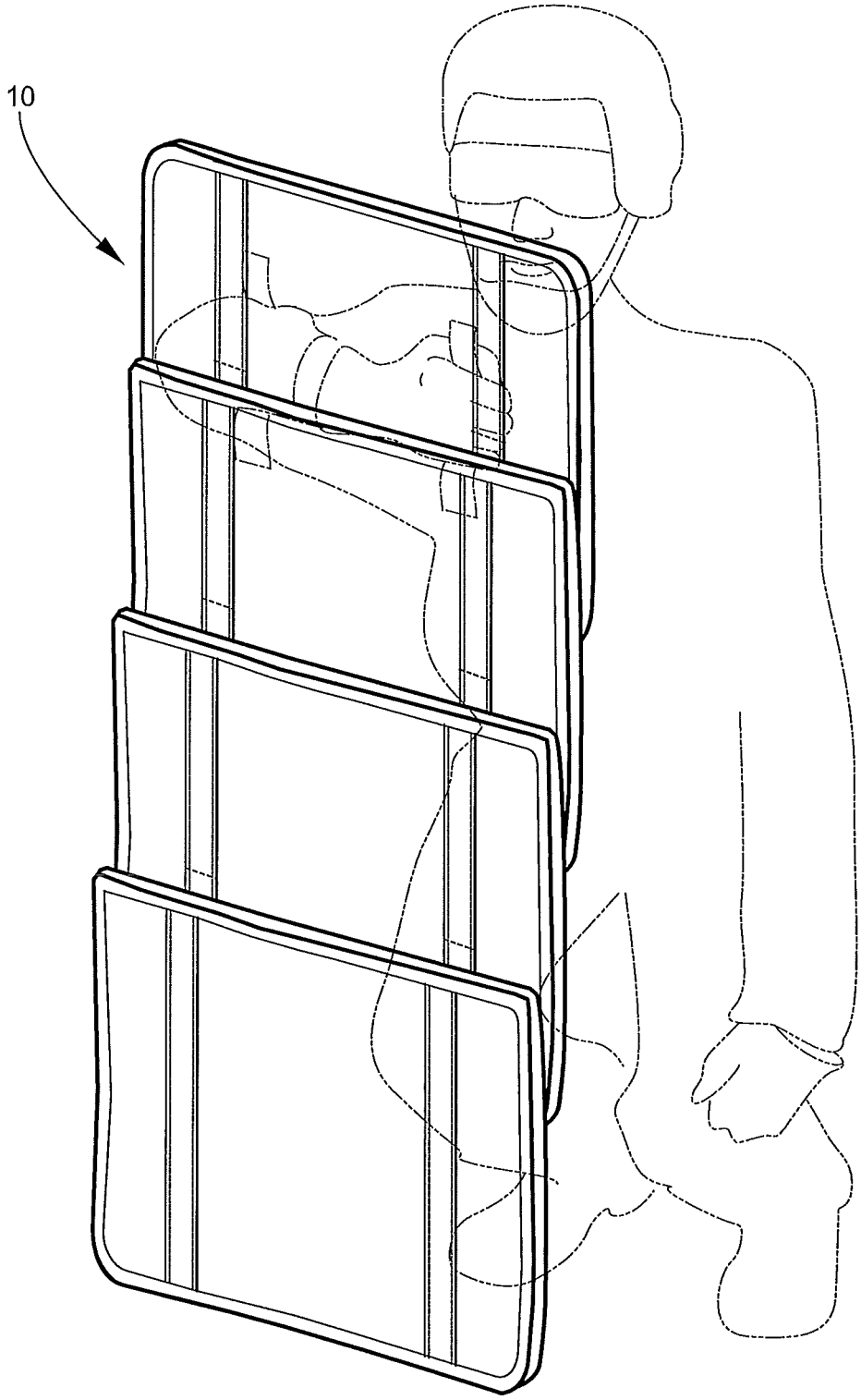
Figure 11:
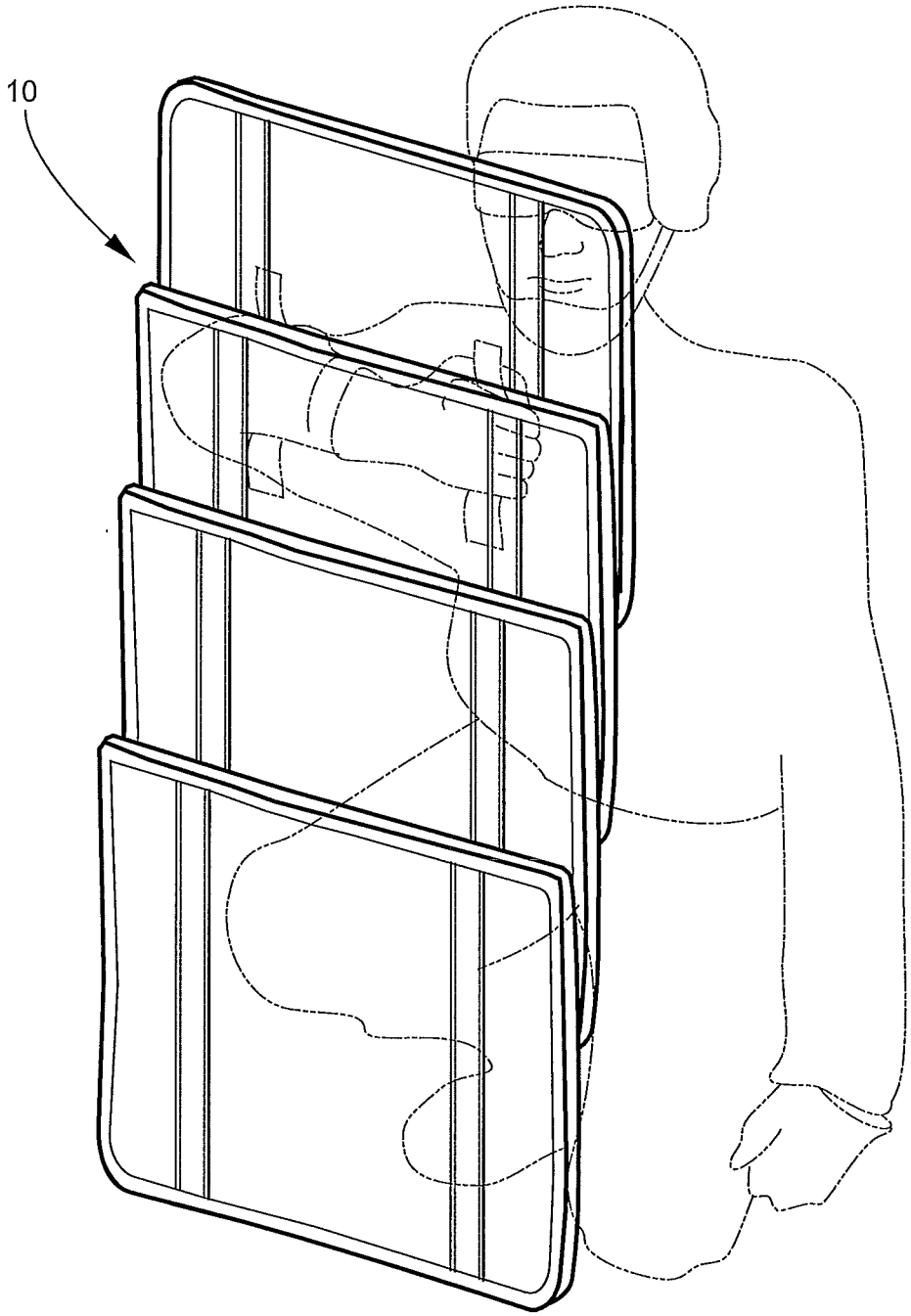

FIGS. 9, 10, and 11 demonstrate automatic convertibility of the ballistic shield 10 from the fully extended or deployed condition, as in FIG. 9, to any other lesser length (or height) needed to maximize user protection. Thus, when the user crouches or drops to one knee, as in FIGS. 10 and 11, the overall height of the ballistic shield 10 automatically adjusts as the bottom panel engages the ground surface.

Figure 12:
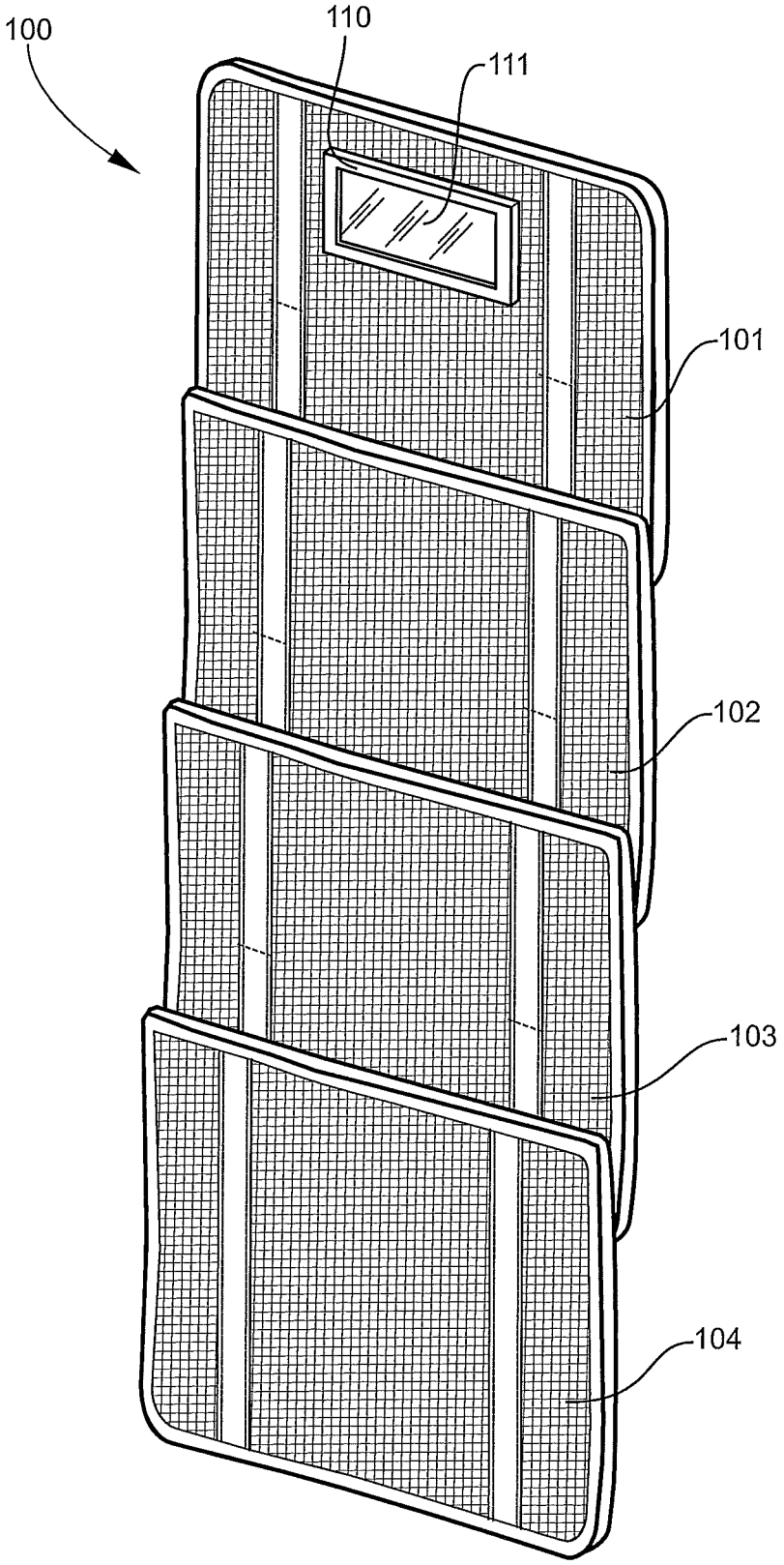
FIG. 12 is a perspective view showing the threat-side surface of a ballistic shield according to an alternative exemplary embodiment.

FIG. 12 illustrates a further embodiment of a convertible ballistic shield 100 incorporating multiple interconnected ballistic panels 101, 102, 103, and 104, such as those described above. In this embodiment, the top ballistic panel 101 comprises a user sight window 110 with a bullet-resistant transparent insert 111. The remaining structure and operation of the ballistic panel 100 may be substantially identical to that previously described.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under §112, 6th paragraph is not intended. Additionally, it is not intended that the scope of patent protection afforded the present invention be defined by reading into any claim a limitation found herein that does not explicitly appear in the claim itself.

What is claimed:

1. A convertible ballistic shield, comprising:

a plurality of cooperating rectangular ballistic panels, each ballistic panel having a threat-side surface and a protected-side surface, and opposing end edges and opposing side edges; and means for slidably interconnecting adjacent ones of said ballistic panels wherein the protected-side surface of one panel is adapted to overlie the threat-side surface of the adjacent panel, and at least one of said adjacent panels is slidably movable relative to the other such that an overall length of said ballistic shield is selectively adjustable between a fully retracted condition and a fully extended condition, and when in the fully retracted condition, said ballistic panels are superimposed such that their respective end and side edges reside in substantial overlying alignment.

2. A convertible ballistic shield according to claim 1, wherein in the fully extended condition of said ballistic shield, said adjacent panels are separated such that the opposing end edges of one panel are substantially linearly displaced from corresponding opposing end edges of the other panel.

3. A convertible ballistic shield according to claim 2, wherein in the fully extended condition of said ballistic shield, said adjacent panels substantially overlap at respective proximal end edges of said panels.

4. A convertible ballistic shield according to claim 1, wherein at least one of said ballistic panels comprises a pocket.

5. A convertible ballistic shield according to claim 4, and comprising a rigid impact plate received within the pocket of said ballistic panel.

6. A convertible ballistic shield according to claim 1, and comprising a flashlight removably carried by one of said ballistic panels.

7. A convertible ballistic shield according to claim 1, and comprising an adjustable arm strap and hand grip located on the protected-side surface of one of said ballistic panels.

8. A convertible ballistic shield according to claim 1, wherein at least one of said ballistic panels incorporates a flexible ballistic laminate structure comprising bundled high performance continuous fibers.

9. A convertible ballistic shield according to claim 8, wherein said high performance continuous fibers are selected from a group consisting of S-glass, aramid, high molecular weight polyethylene (HMWPE), polybenzobisoxazole (PBO), and polypyridobisimidazole (PIPD).

10. A convertible ballistic shield according to claim 1, wherein in the fully retracted condition, said overlying ballistic panels have a combined thickness of less than 6 inches.

11. A convertible ballistic shield according to claim 1, wherein at least one of said ballistic panels comprises a substantially transparent sight window.

12. A convertible ballistic shield according to claim 1, wherein the overall length of said ballistic shield in the fully extended condition is greater than 3 times the overall length of said ballistic shield in the fully retracted condition.

* * * * *